US007956818B1

(12) United States Patent
Hsu et al.

(10) Patent No.: US 7,956,818 B1
(45) Date of Patent: Jun. 7, 2011

(54) LEAKY COAXIAL CABLE WITH HIGH RADIATION EFFICIENCY

(75) Inventors: Tsung-Yuan Hsu, Westlake Village, CA (US); James H Schaffner, Chatsworth, CA (US)

(73) Assignee: HRL Laboratories, LLC, Malibu, CA (US)

( * ) Notice: Subject to any disclaimer, the term of this patent is extended or adjusted under 35 U.S.C. 154(b) by 447 days.

(21) Appl. No.: 12/211,983

(22) Filed: Sep. 17, 2008

(51) Int. Cl.
*H01Q 1/36* (2006.01)

(52) U.S. Cl. ..... 343/895; 343/897

(58) Field of Classification Search ..... 343/895, 343/897

See application file for complete search history.

(56) References Cited

U.S. PATENT DOCUMENTS

| | | | | |
|---|---|---|---|---|
| 3,601,721 | A | 8/1971 | Park | |
| 4,008,479 | A * | 2/1977 | Smith | 343/895 |
| 4,152,648 | A | 5/1979 | Delogne | |
| 4,339,733 | A | 7/1982 | Smith | |
| 5,898,350 | A | 4/1999 | Aberasturi | |
| 5,936,203 | A | 8/1999 | Ryman | |
| 6,690,336 | B1 * | 2/2004 | Leisten et al. | 343/895 |
| 7,113,148 | B2 * | 9/2006 | Lan et al. | 343/895 |
| 7,471,258 | B2 | 12/2008 | Hsu | |

OTHER PUBLICATIONS

Non Final Office Action for U.S. Appl. No. 12/252,189, dated Jul. 8, 2010.

Hill, Propagation ALong A coaxial Cable with a Helical Shield, IEEE Transactions on Microwave Theory And Techniques, vol. MTT-28, No. 2, Feb. 1988.

* cited by examiner

*Primary Examiner* — Tan Ho

(74) *Attorney, Agent, or Firm* — George R. Rapacki; Daniel R. Allemeier

(57) ABSTRACT

An leaky coaxial cable antenna with high radiation efficiency and low insertion loss is described. The outer shield of the coaxial cable is constructed to facilitate energy transfer between the bifilar mode and the monofilar mode by constructing the outer conductor of a first conductive strip wrapped in a spiral about the dielectric and a plurality of second conductive strips wrapped in a counter spiral about the first but spaced serially along the length of the coaxial cable such that portions of the cable are wrapped by a single spiral and the other portions are wrapped by two spirals.

23 Claims, 8 Drawing Sheets

D: double wrap section, 8 total

S: Single wrap section, 2 at 11cm, 5 at 6cm

Figure 3 Schematic of 100cm leaky coax outer shield structure

LEAKY COAXIAL CABLE WITH HIGH RADIATION EFFICIENCY

STATEMENT REGARDING FEDERALLY SPONSORED RESEARCH OR DEVELOPMENT

This invention was made with Government support under Contract No. W25P7T-06-C-P608 awarded by ARMY/CERDEC. The Government has certain rights in the invention.

CROSS REFERENCE TO RELATED APPLICATIONS

Coaxial Cable Having High Radiation Efficiency application Ser. No. 11/412,575 filed Apr. 26, 2006 and application Ser. No. 12/193,500 filed Aug. 18, 2008. The related applications have one or more inventors in common or are commonly owned.

BACKGROUND

This disclosure is generally related to flexible antennas having materials that leak radio frequency (RF) energy and, in particular, to an antenna made of coax cable that efficiently leaks RF energy over a short length with low return loss Leaky coaxial cables have been used over the past several decades for applications such as distributing signals inside tunnels and mines, and along roadways. See for example "Propagation Along a Coaxial Cable with a Helical Shield", D. A. Hill, J. R. Wait, IEEE Transactions on Microwave Theory and Techniques, vol. 28, no. 2, pp. 84-89, February 1980 and "Theory and Analysis of Leaky Coaxial Cables with Periodic Slots", J. H. Wang, K. K. Mei, IEEE Transactions on Antennas and Propagation, vol. 49, no. 12, pp. 1723-1733, December 2001. Typically, these are ordinary coaxial cables with slots cut into them, loose braids, or helical shields. They are often designed so that the signals leak out over a distance of several kilometers.

U.S. Pat. No. 5,936,203 to Henry Ryman describes a radiating coaxial cable comprising a center conductor, a dielectric core and a plurality of conductive strips wrapped around the dielectric in a spiral. In one embodiment two strips are continuous and wrapped in opposite directions around the dielectric core along the entire length. The present invention has a first wrap along the entire length but is distinguished from Ryman in that the second wrap is not continuous along the entire length.

HRL application Ser. No. 11/412,575 filed Apr. 26, 2006, incorporated by reference in its entirety, disclosed a new kind of leaky cable that is a few millimeters thick, and can radiate efficiently within a length of about one meter. However, high radiation efficiency was achieved at a price of high return loss. The other noticeable problem was significant variation observed in antenna gain over the desirable frequency ranges. HRL application Ser. No. 12/193,500 filed Aug. 18, 2008, incorporated be reference in its entirety, disclosed a leaky cable antenna with low insertion losses. This invention discloses a high radiation efficiency coaxial cable antenna with low return loss and improved antenna gain over the designed frequency ranges.

There is a need to provide coax cable that efficiently radiates RF energy in a short length with substantially uniform gain and low return loss.

SUMMARY

In a first embodiment, a leaky coaxial cable antenna comprising: a center conductor surrounded by a dielectric for the length of the center conductor, a first conductive strip with a width wrapped about the dielectric and coaxial with the center conductor, a second conductive strip of a second width wrapped about the dielectric and coaxial with the center conductor, wherein the first conductor is wrapped in a spiral in a first direction along the length at a first pitch, and the second conductor is wrapped at a second pitch in a second direction along a portion of the length, in electrical contact with the first conductive strip.

In another embodiment, the preceding leaky coaxial cable wherein one or more of the first width, first pitch, second width and second pitch vary with the length of the leaky coaxial cable antenna.

In another embodiment, the preceding leaky coaxial cable wherein one or more of the first width, first pitch, second width and second pitch are fixed.

In another embodiment, the preceding leaky coaxial cable wherein the first spiral direction reverses one or more times along the length of the antenna.

In another embodiment, the preceding leaky coaxial cable wherein the second spiral direction reverses one or more times along the length of the antenna.

In another embodiment a leaky coaxial cable antenna comprising: a center conductor surrounded by a dielectric the length of the center conductor, a first conductive strip of a first width wrapped about the dielectric at a first pitch in a first spiral direction and coaxial with the center conductor, a plurality of second conductive strips of a second width wrapped about the dielectric at a second pitch in a second spiral direction, coaxial with the center conductor, and wherein the plurality of second conductive strips are in electrical contact with the first conductive strip and distributed serially along the length of the dielectric. In alternative embodiments the plurality of second conductive strips may be distributed uniformly. In another alternative embodiment the coaxial cable may comprise an impedance matching section connecting the coaxial cable antenna to a transmitter. In other alternative embodiments the first and second pitch are substantially not equal and independently, the first and second spiral directions are not equal.

In another embodiment, the preceding leaky coaxial cable wherein one or more of the first width, first pitch, second width and second pitch vary with the length.

In another embodiment, the preceding leaky coaxial cable wherein one or more of the first width, first pitch, second width and second pitch are fixed.

In another embodiment, the preceding leaky coaxial cable wherein the first spiral direction reverses one or more times along the length of the antenna.

In another embodiment, one of the preceding embodiments further comprises integration of the leaky antenna into a wearable garment.

In another embodiment, a method of forming a leaky coaxial cable antenna by coaxially surrounding a center conductor with a dielectric along the length of the center conductor then coaxially wrapping the dielectric with a conductive strip of first width in a first spiral direction at a first pitch and then coaxially wrapping the dielectric and first conductive strip in a plurality of second conductive strips of a second width in a second spiral direction at a second pitch. The second conductive strips are in electrical contact with the first conductive strip.

In alternative methods of forming a leaky coaxial antenna of the previous embodiment the plurality of second conductive strips are distributed uniformly, the first pitch is not necessarily equal to the second pitch, or the first spiral direction is not necessarily equal to the second spiral direction.

In alternative methods of forming a leaky coaxial antenna of the previous embodiment, one or more of the first pitch, first width, second pitch, second width vary with the length of the antenna.

In alternative methods of forming a leaky coaxial antenna of one of the previous embodiments, one or more of the first spiral direction and the second spiral direction reverse one or more times along the length of the antenna.

DESCRIPTION

Figure 1:
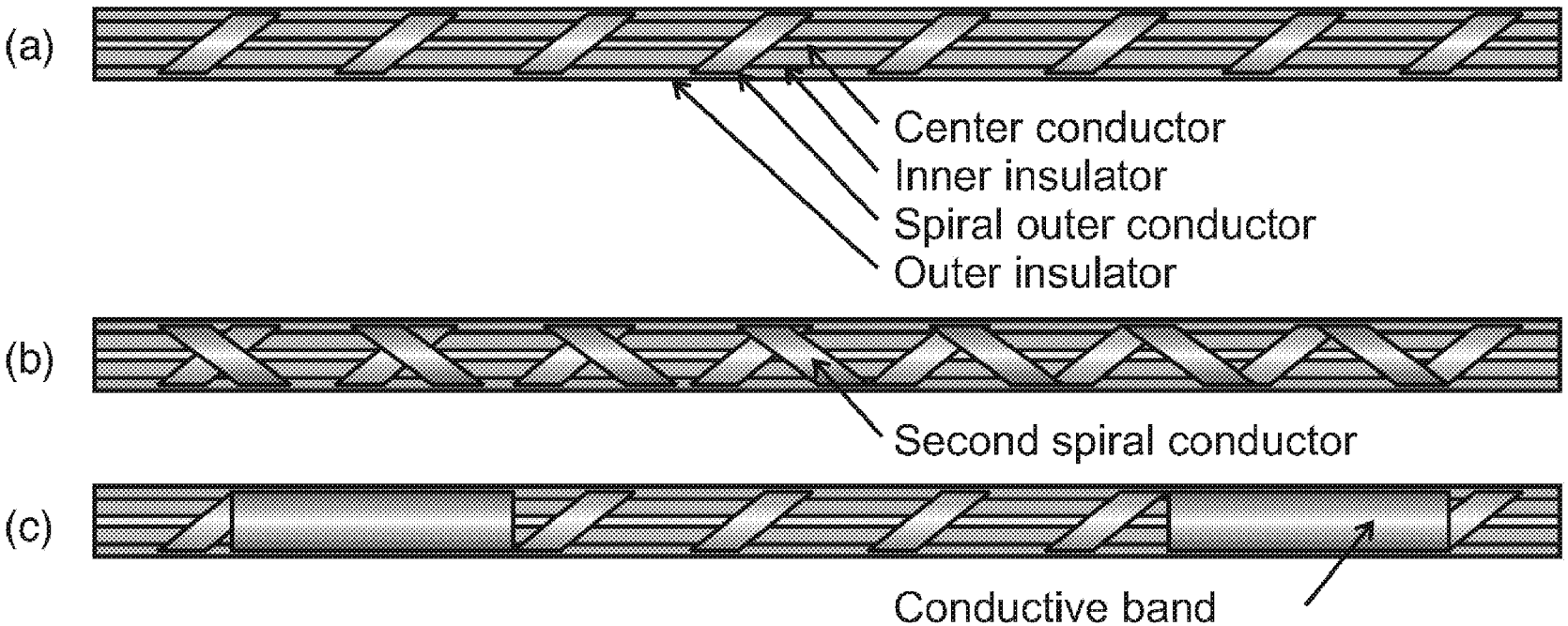
Prior Art Figure 1
FIG. 1*a* shows prior art leaky coaxial cable antenna made of one spiral wrap.
FIG. 1*b* shows a leaky coaxial antenna with a second spiral wrap along the entire length of the cable.
FIG. 1*c* shows a prior art leaky coaxial cable made of a single spiral wrap but with solid conductor bands spaced on top of the spiral wrap.

The present invention will be understood and appreciated more fully from the following detailed description taken in conjunction with the drawings described below. The following description is presented to enable one of ordinary skill in the art to make and use the invention and to incorporate it in the context of particular applications. Various modifications, as well as a variety of uses in different applications will be readily apparent to those skilled in the art, and general principles defined herein may be applied to a wide range of embodiments. This invention may be embodied in many different forms and should not be construed as limited to the embodiments set forth herein. Further, the dimensions and other elements shown in the accompanying drawings may be exaggerated to show details. The present invention should not be construed as being limited to the dimensional relations shown in the drawings, nor should the individual elements shown in the drawings be construed to be limited to the dimensions shown. Thus the present invention is not intended to be limited to the embodiments presented, but is to be accorded the widest scope consistent with the principles and novel features disclosed herein.

In the following description, numerous specific details are set forth in order to provide a more thorough understanding of the present invention. However, it will be apparent to one skilled in the art that the present invention may be practiced without necessarily being limited to specific details. In other instances, well-known structures and devices are shown in block diagram form or schematically, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All features disclosed in this specification, (including any accompanying claims, abstract, and drawings) may be replaced by alternative features serving the same, equivalent or similar purpose, unless expressly stated otherwise. Unless expressly stated otherwise, each feature disclosed is one example only of a generic series of equivalents or similar features.

Any element in a claim that does not explicitly state "means for" performing a specified function, or "step for" performing a specific function, is not to be interpreted as a "means" or "step" clause as specified in 35USC Section 112, Paragraph 6. In particular, the use of step of or act of in the claims herein is not intended to invoke the provisions of 35USC Section 112 Paragraph 6.

A short length leaky coaxial cable antenna is uniquely suited for integration in tactical combat wear in both its form factor and RF performance. The leaky cable antenna may be sewn into clothing or incorporated in armor because it is thin, flexible, and lightweight. Because it radiates over its entire length, it is not significantly detuned by the local environment and can operate near body armor or skin. It can also operate near moisture, and will not be shorted out if a portion of its length becomes wet. It will work in close proximity to metal objects. Compared to conventional antenna designs (spirals, dipoles, bow-ties, etc.) the leaky coaxial cable antenna is immune to single point failures or blockage, because if one portion of the antenna is covered the rest of its length can still radiate. When the leaky cable antenna is installed into the tactical combat wear it radiates in an omnidirectional pattern because a portion of the antenna is likely exposed in any given direction. Thus, it works regardless of the wearer's position or orientation. It can also be expected to have a lower specific absorption rate (SAR), compared to single point radiators such as dipoles, because the radiation fields are distributed over a larger distance, rather than concentrated at one point.

To design a broad band leaky cable antenna of short length (~1 meter) with high gain and low return loss has always been a challenge to the antenna designer. It is well understood that to convert guided modes in a cable into radiation modes requires altering the propagation characteristic of the cable. The propagation characteristic change becomes very significant when an efficient conversion has to be achieved within a short length (~1 meter or less). Consequently, a short length design will have a significant impedance mismatch between antenna and transmitter/receiver and result in high return loss.

The operation of spiral-wound leaky cables has been discussed in application Ser. No. 11/412,575 filed Apr. 26, 2006 and "Theory and Analysis of Leaky Coaxial Cables with Periodic Slots", J. H. Wang, K. K. Mei, IEEE Transactions on Antennas and Propagation, vol. 49, no. 12, pp. 1723-1733, December 2001. A coaxial cable with a single spiral outer conductor is essentially a two-wire transmission line that supports two modes, the bifilar mode and the monofilar mode. The bifilar mode looks much like the mode of an ordinary solid coaxial cable, but modified because of the spiral shape of the outer conductor. The bifilar mode's electric field is between the center conductor and the spiral outer conductor. It traverses around the cable as it propagates The monofilar mode is similar to that of a single-wire transmission line with a dielectric coating, and its fields are largely concentrated in the air region around the wire. There is no return conductor in this case, and one may consider the return path to be a notional ground plane that is an infinite distance from the cable.

On a perfectly uniform cable, neither of these two modes radiate, since their phase velocity is slower than the speed of light. The phase velocity of the bifilar mode is governed by the inner dielectric insulator. However, the phase velocity of the monofilar mode is just slightly slower than the speed of light, which means that it is only loosely bound to the cable, and extends a significant distance into free space. This mode is easily scattered by discontinuities or bends in the cable. Thus, traditional spiral wound leaky cables work because of the constant flow of energy between these two weakly coupled modes, with the monofilar mode gradually leaking away power into the surrounding space. As a result, conventional leaky cable antennas typically require hundreds of wavelengths or more to radiate efficiently, making them suitable for use inside tunnels or along roadways.

Application Ser. No. 11/412,575 filed Apr. 26, 2006 discloses techniques to significantly increase the rate of conversion between the two modes, and thus greatly reduce the length of cable required for efficient radiation. FIGS. 1*b* and *c* shows two examples of such mode conversion structures, compared to an ordinary spiral cable FIG. 1*a*. One structure includes a second spiral that is wound in the direction opposite to the first. If the two spirals have exactly the same pitch, this cable performs similarly to ordinary single spiral coax. However, if they have slightly different pitches, the waves are scattered by the spatial beat frequency between the two spirals, resulting in more rapid mode conversion and efficient radiation. A second method for increasing the radiation rate is to attach periodic conductive bands along the cable. These bands tend to scatter energy between the two modes and increase their coupling, thus increasing the radiation efficiency for a short length of cable. Experimental results showed that the conductive bands exhibited far more radiation efficiency than the double spirals in the cable length of 1 meter or less but with much higher return loss (−5.5 dB versus −10 dB). This invention discloses a new method that demonstrates high radiation efficiency with a lower return loss.

The double wrapped coaxial cable with slightly different pitches for each wrap shown in FIG. 1*b* has more rapid mode conversion and efficient radiation by 1-2 orders of magnitude over two opposite spirals of equal pitches but the total efficiency is poor for a short cable length of ~1 meter. The efficiency is poor because of the higher insertion loss. On the other hand the propagation modes in a single spiral cable are far more loosely guided than a cable with a double spiral of equal pitches and can be converted into radiation efficiently with boundary perturbation such as bending or attaching period conductive bands along the cable, as shown in FIG. 1*c*. However, adding these usually lossy conductive bands also significantly increase the cable's insertion loss and also increase impedance mismatch between cable and transmitter/receiver resulting in high return loss (30-40%). The conversion efficiency was limited to 30-40% with loss a return loss of −5 to −6 dB for a 1 meter long cable.

Figure 2:
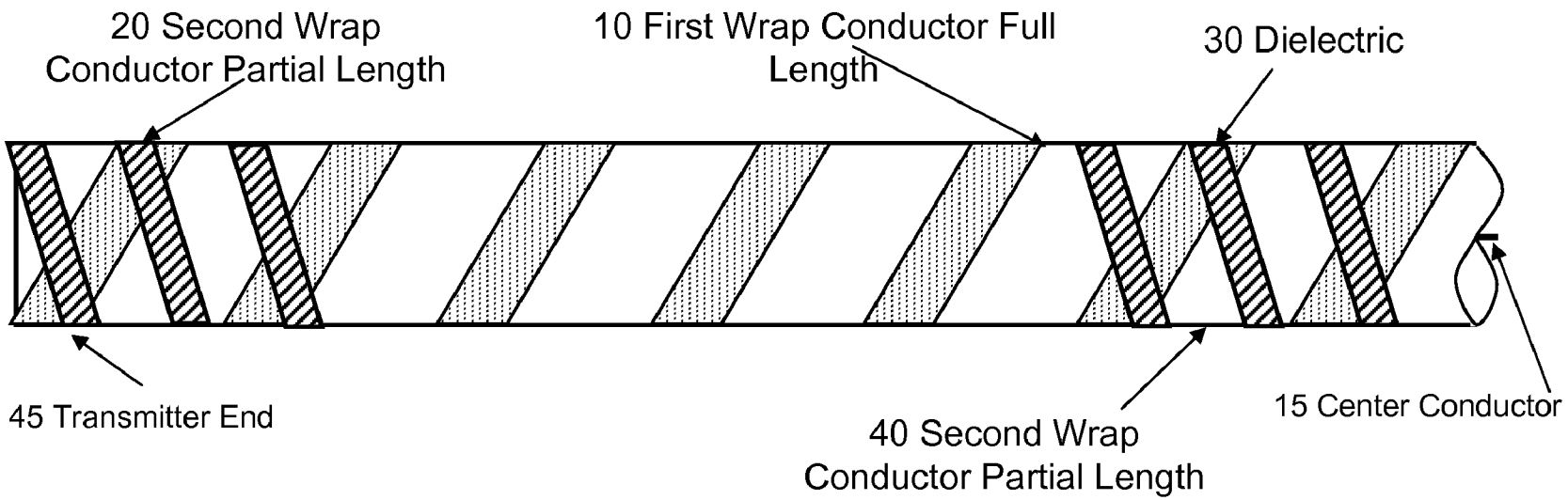
FIG. 2 shows details of the present disclosure.
Figure 3:
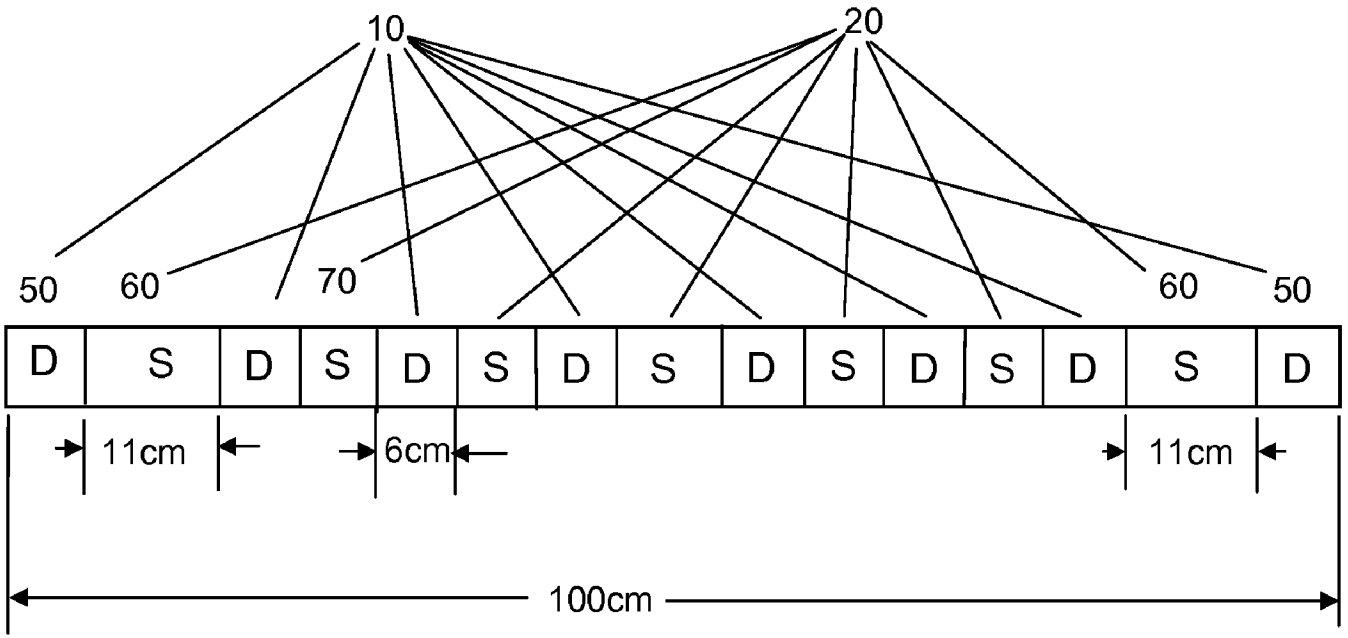
FIG. 3 shows a schematic of one embodiment of the leaky coaxial antenna.

The leaky coaxial cable antenna shown in FIGS. 2 and 3 with a series of discrete serially distributed second spirals can lower the return loss while achieving high radiation efficiency. The discrete second spiral wraps 20 act like conductive bands to increase the coupling efficiency between two modes but with a shorter conductive path (i.e. lower insertion loss). These second spiral wraps 20 also scatter energy between two modes like conductive bands but distributed over the entire length of the double spiral instead of at the interface of the single spiral wrap and conductive band. Therefore, the abrupt discontinuity at interfaces is eliminated and high return loss and significant gain variation resulting from the multiple reflections within the cable can be greatly reduced.

FIG. 2 shows a coaxial cable with a first spiral wrap 10 over dielectric 30 and center conductor 15 along the entire length of the cable and a plurality of second spiral wraps 20 and 40 located along the length of the cable. The second spiral wraps may be spaced uniformly but not necessarily. Transmitter end 45 uses a first and second wrap to minimize the power reflected back to the transmitter. In an alternative embodiment, the transmitter end 45 of the leaky coax antenna would have a conductive sleeve to function as an impedance matching section instead of the second spiral wrap.

FIG. 3 is a schematic of an exemplary embodiment of a one (1) meter leaky cable antenna. The 100 cm leaky cable antenna is composed of a first spiral wrap 10 and a plurality of second spiral wraps 20 distributed serially. The first spiral is along the entire length but exposed in the gaps between the second spirals. The second spiral wraps 20 are 6 cm along the length, at a pitch of 0.5 cm with a width of 0.3175 cm. The cable shown has lengths of double wrapping marked 50 where the first 10 and second 20 spirals are exposed and lengths of single wrapping marked 60 and 70 where the first spiral 10 is exposed. The single wrapping lengths 60 and 70 are not all of equal length. Some of the single wrapping lengths are 11 cm long and some are 6 cm long. The cable shown in 0.3175 cm in diameter.

Figure 4:
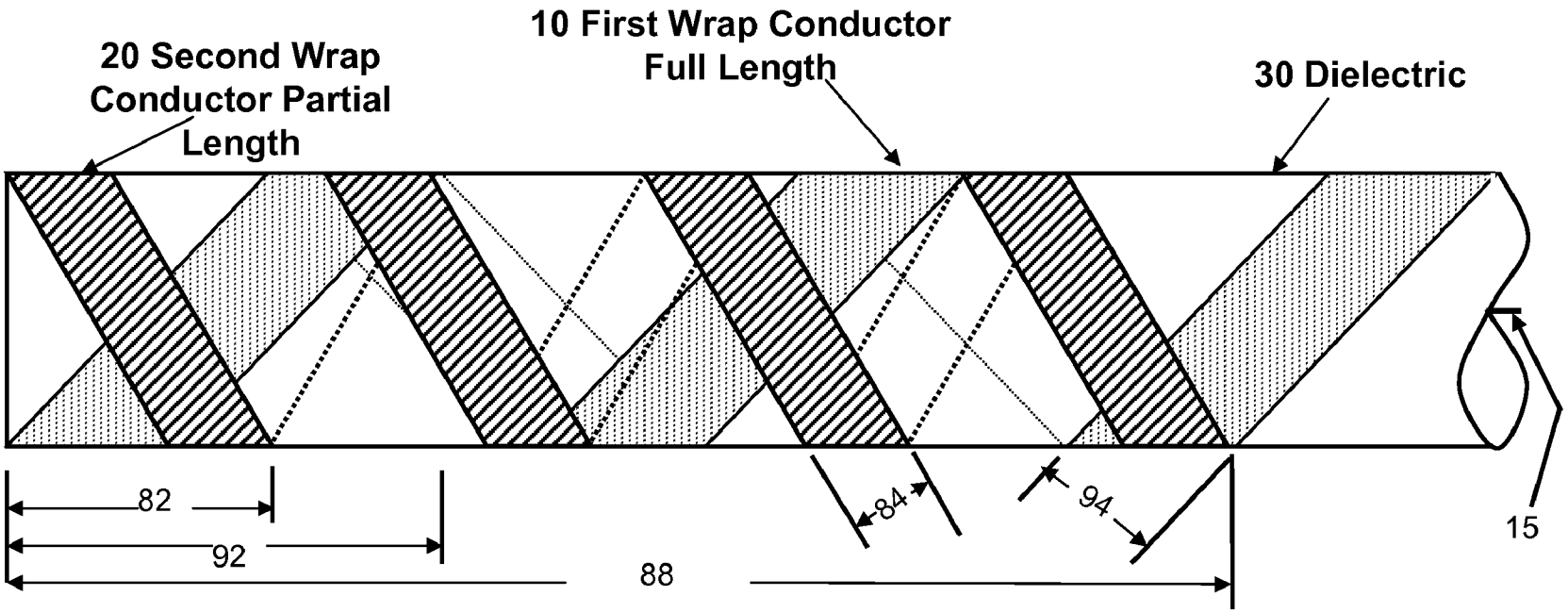
FIG. 4 shows more details of the leaky coaxial antenna with a plurality of second spiral wraps.

FIG. 4 shows the details of the first wrap 10 around the dielectric 30 and over the center conductor 15. The first wrap has a first pitch 92 and first width 94. The second wrap 20 has a second pitch 82, a second width 84 and a length 88. The first pitch 92 is not necessarily equal to the second pitch 82. The first width 94 is not necessarily equal to the second width 84. Additional wraps may be added to FIG. 4 at the same or different pitch and width as the first wrap 10 and second wrap 20 depending on the desired characteristics.

The parameters of the two spirals were determined experimentally and with the aid of a design tool such as High Frequency Structure Simulator v11 from Ansoft Corporation, 225 West Station Square Dr. Suite 200, Pittsburgh Pa. 15219, or the equivalent.

It should be understood that the embodiments of a double wrapped leaky coaxial cable antenna may include one or more outer coverings of insulating and or reinforcing materials to protect the coaxial cable from the elements and environment.

Figure 5:
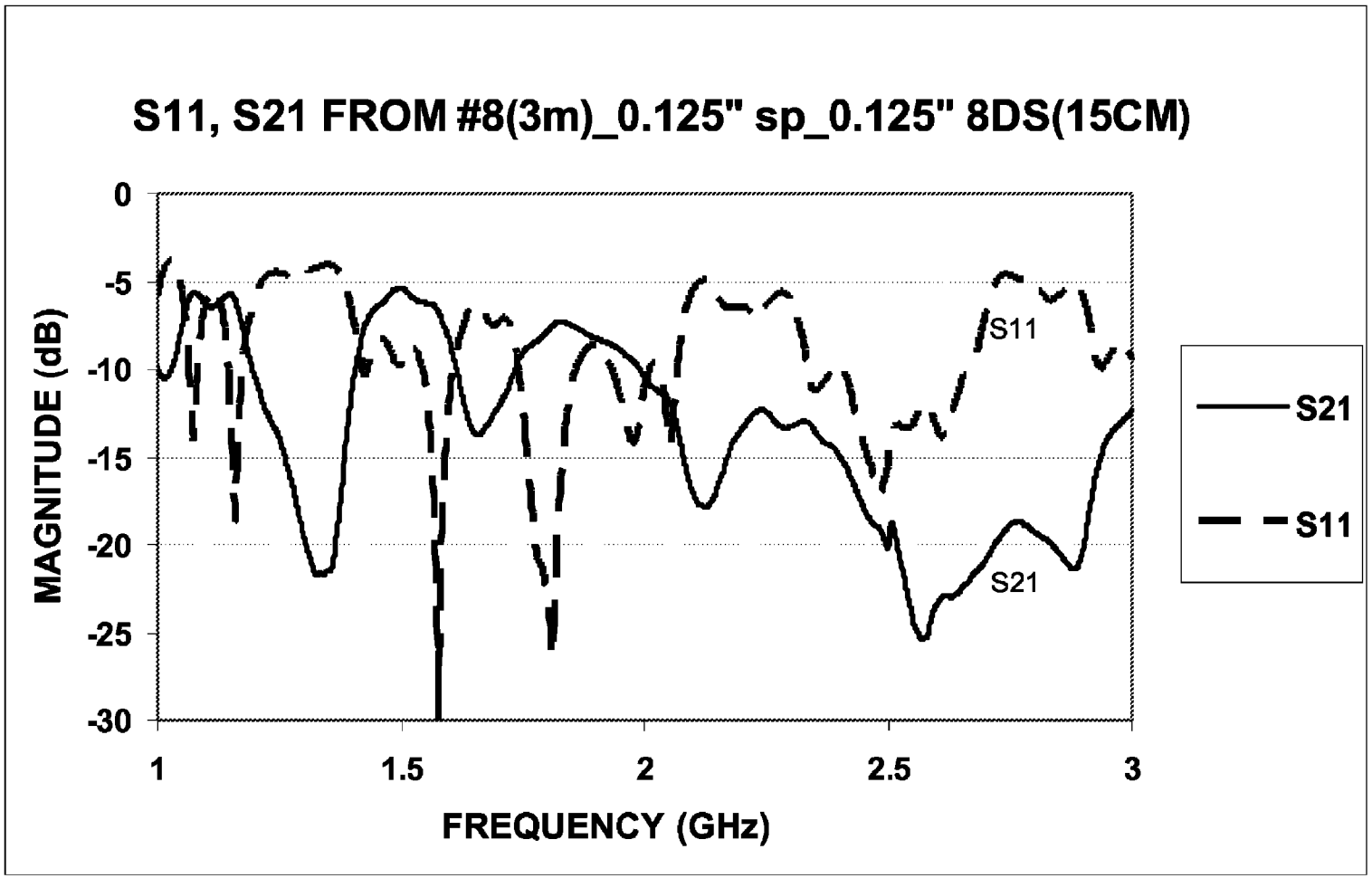
FIG. 5 shows the S parameters for the embodiment of leaky coaxial antenna shown in FIGS. 2 and 3.
Figure 6:
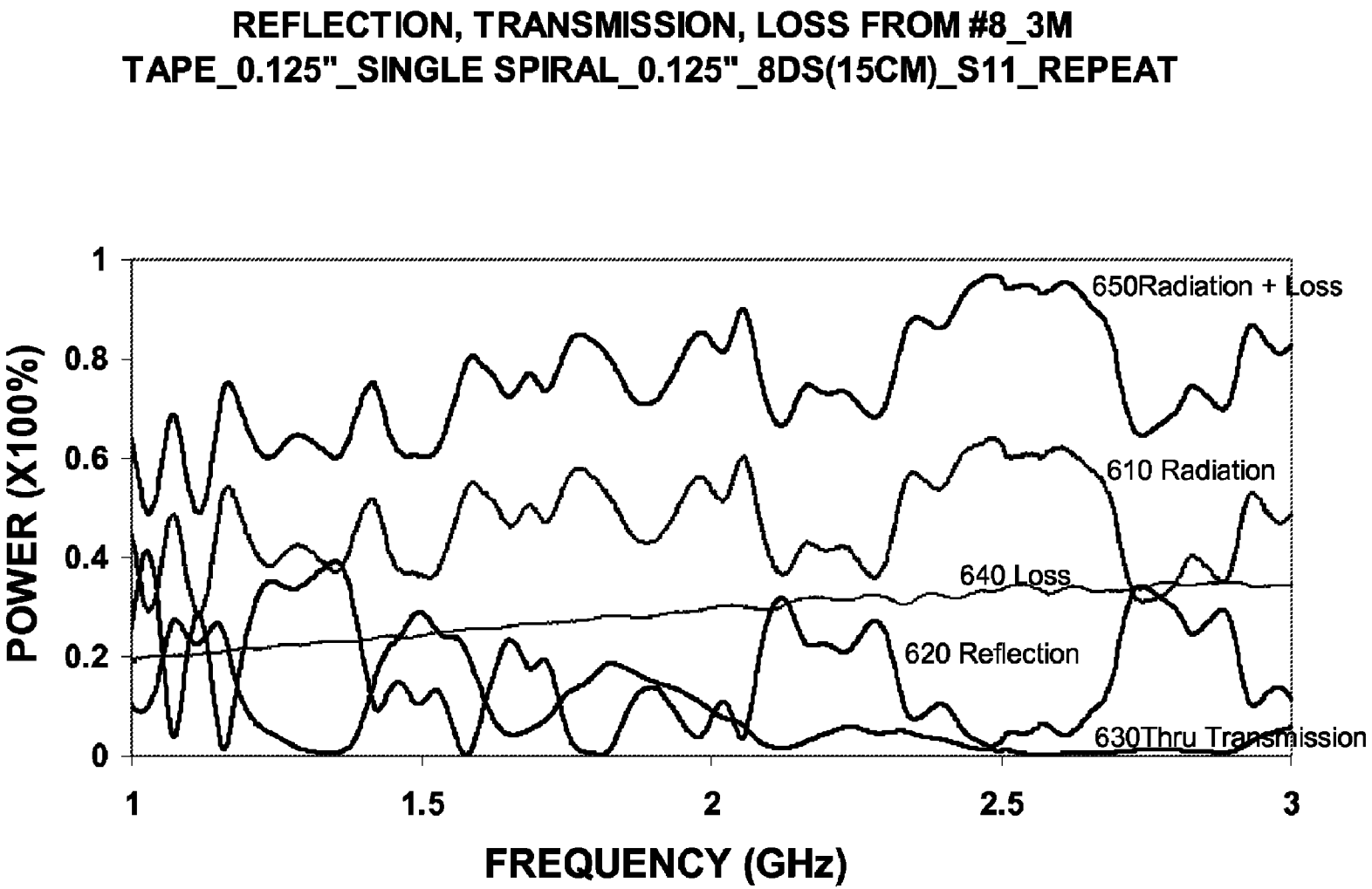
FIG. 6 shows the reflection, transmission and loss from the leaky coaxial antenna in FIGS. 2 and 3.

FIGS. 5 and 6 illustrate the performance of the embodiment in FIG. 3. FIG. 5 shows the transmitted power S21 and the reflected power S11. The transmitted power is the fraction of the input power that reaches the end of the cable. Ideally the transmitted power is zero. The reflected power, S11 is the fraction of the input power that is reflected back at the transmitter. Ideally the reflected power is zero. The radiated power, assuming no loss in the cable itself due to resistance and imperfect dielectric is the input power less the reflected power less the transmitted power. FIG. 6 shows these values.

Radiation efficiency is defined as the radiated power divided by the input power. When expressed as a percentage, the radiation efficiency is the percentage radiation 610 in FIG. 6. Return loss is defined as the reflected power 620.

In FIG. 6 the transmitted power 630 is roughly 10% and is comparable to S12 in FIG. 5. The reflected power 620 is roughly 20% of the input and is comparable to S11 in FIG. 5. The loss due to resistive heating and imperfect dielectric is marked 640 Loss, and is roughly 28%. The remaining power is radiated by the leaky coax. The loss 640 plus the radiated 610 power is shown in 650. The radiated power 610 is the useful power for this application and is roughly 50%.

Figure 7:
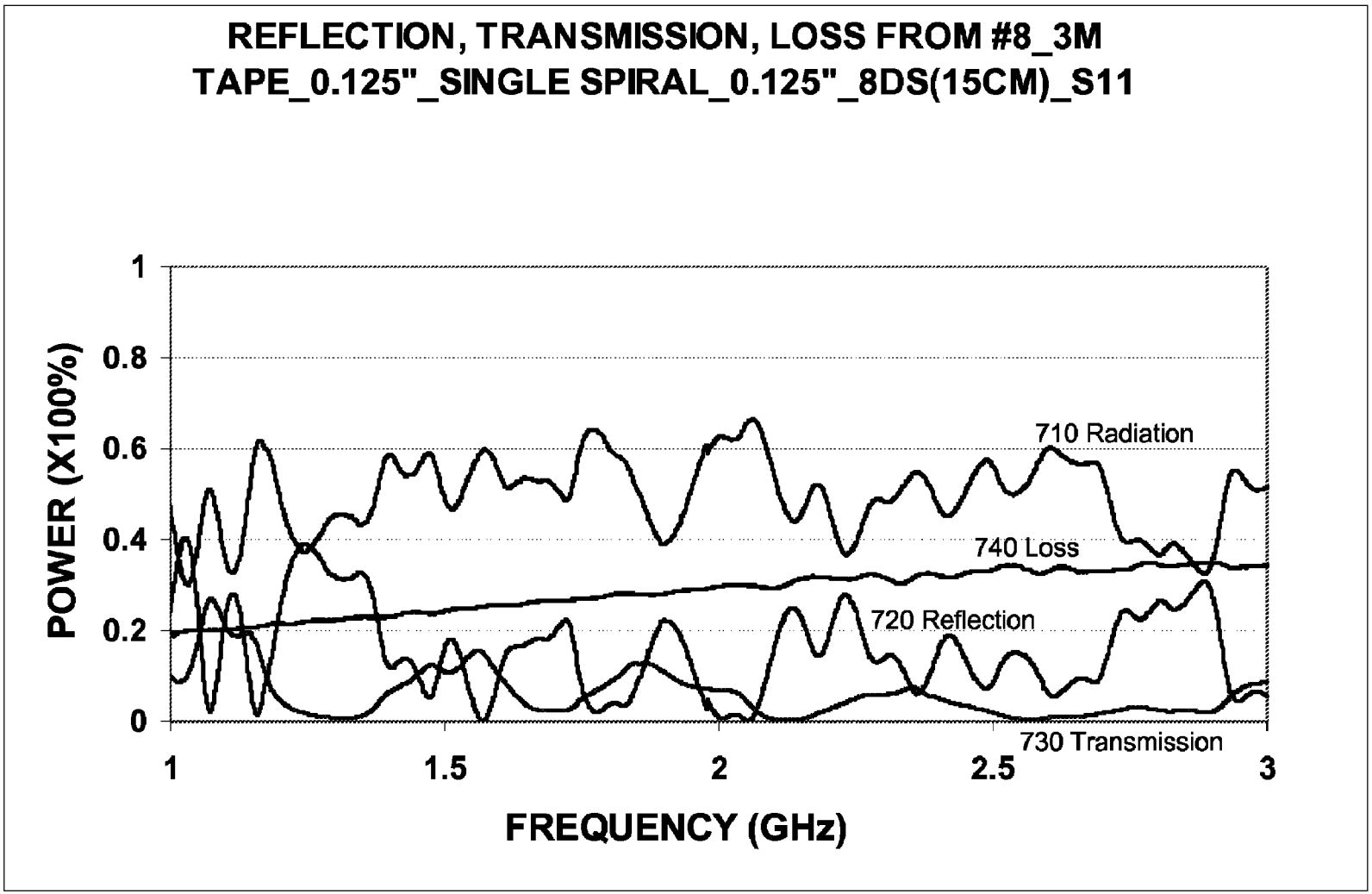
FIG. 7 shows the reflection, transmission and loss from the leaky coaxial antenna with uniform length second spirals.

FIG. 7 plots the performance of an alternate embodiment comprising a 0.3175 cm diameter coax antenna 100 cm long, with a single spiral of 0.3175 cm wide copper at a pitch of 0.5 cm and eight serially distributed second spirals of the same pitch and width wrapped in the opposite direction where each second spiral is approximately 6 cm long. This embodiment differs from the embodiment shown in FIG. 3 in that all the single spiral exposures 20 are the same length while the single wrap exposures 20 in the embodiment of FIG. 3 have first and last exposures 60 longer than the intervening exposures 70. The radiation efficiency or fraction of input power is 710, the reflection loss is 720, the resistive heating an imperfect dielectric loss is 740 and the transmitted power is 730. The average values for this second embodiment is comparable to the average values of the first embodiment.

Figure 8:
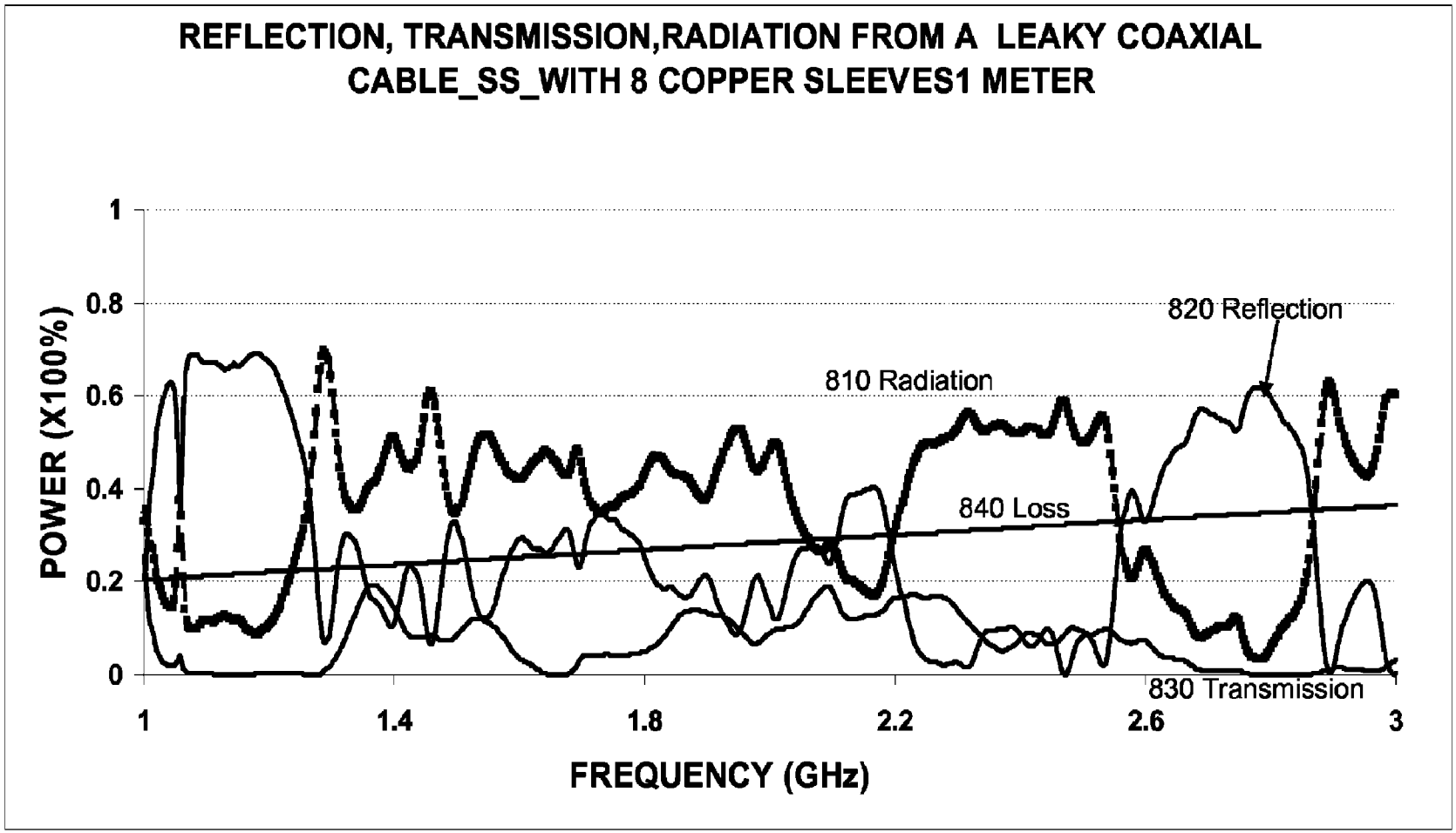
FIG. 8 shows the reflection, transmission and loss from the leaky coaxial antenna with the second spirals replaced with conductive bands.

FIG. 8 is directly comparable to FIG. 7 and illustrates the performance difference between using conductive bands and serially distributed second spirals. FIG. 8 shows the performance of a 100 cm coax antenna with the same single spiral as in FIG. 7 but eight conductive sleeves or bands instead of the second spirals. Each sleeve is approximately 1.5 cm long. In comparing FIGS. 7 to 8, note the loss 740 and 840 is nearly identical as one would expect since the same materials were used but that FIG. 7 shows greater radiation 710 than the radiation 810 in FIG. 8 although FIG. 8 shows less reflection 820. The radiation 710 is FIG. 7 is roughly 50% and the reflected power 720 is roughly 15% while the radiation 810 is roughly 40% in FIG. 8 and the reflected power is roughly 25%. Discrete serially distributed second spirals allow for a 1 meter long coaxial antenna with greater radiated power efficiency and lower reflected power when compared to conductive bands. This is because the double spirals provide smaller discontinuities in the boundary conditions defining the monofilar and bifilar modes than do the conductive sleeves.

From the foregoing description, it will be apparent that the present invention has a number of advantages, some of which have been described herein, and others of which are inherent in the embodiments of the invention described or claimed herein. Also, it will be understood that modifications can be made to the device and method described herein without departing from the teachings of subject matter described herein. As such, the invention is not to be limited to the described embodiments except as required by the appended claims.

What is claimed is:

1. A leaky coaxial cable antenna comprising:

a center conductor with a length;

a dielectric surrounding the center conductor for the length;

a first conductive strip of a first width wrapped about the dielectric and coaxial with the center conductor;

a second conductive strip of a second width wrapped about the dielectric and first conductive strip, in electrical contact with the first conductive strip, and coaxial with the center conductor;

wherein the first conductor is wrapped in a spiral in a first direction along the length at a first pitch; and wherein the second conductor is wrapped at a second pitch in a second direction along a portion of the length; and wherein the first pitch, second pitch, first width and second width vary with the length.

2. The leaky coaxial cable antenna of claim 1 wherein the first width is constant.

3. The leaky coaxial cable antenna of claim 1 wherein the first pitch is constant.

4. The leaky coaxial cable antenna of claim 1 wherein the first width, first pitch, second width and second pitch are constant.

5. The leaky coaxial cable antenna of claim 1 wherein the first spiral direction reverses one or more times along the length.

6. The leaky coaxial cable antenna of claim 1 wherein the second spiral direction reverses one or more times along the length.

7. A leaky coaxial cable antenna comprising:

a center conductor with a length;

a dielectric surrounding the center conductor for the length;

a first conductive strip of a first width wrapped about the dielectric at a first pitch in a first spiral direction and coaxial with the center conductor; and a plurality of second conductive strips of a second width wrapped about the dielectric at a second pitch in a second spiral direction, coaxial with the center conductor, and;

wherein the plurality of second conductive strips are in electrical contact with the first conductive strip and distributed serially along the length of the dielectric.

8. The leaky coaxial cable antenna of claim 7 wherein the plurality of second conductive strips are uniformly distributed along the length.

9. The leaky coaxial cable of claim 7 further comprising an impedance matching section at an end of the coaxial cable antenna.

10. The leaky coaxial cable antenna of claim 7 wherein the antenna is integrated into a wearable garment.

11. The leaky coaxial cable antenna of claim 7 wherein the length is less than or equal to 100 centimeters.

12. The leaky coaxial cable antenna of claim 7 wherein the first pitch is substantially not equal to the second pitch.

13. The leaky coaxial cable antenna of claim 7 wherein the first spiral direction is substantially not equal to the second spiral direction.

14. The leaky coaxial cable antenna of claim 7 wherein the first width, first pitch, second width and second pitch vary with the length of the antenna.

15. The leaky coaxial cable antenna of claim 7 wherein the first spiral direction reverses one or more times along the length.

16. Radiating coaxial cable antenna having high radiation efficiency and low return loss comprising:

center conductor means for carrying electromagnetic signals;

surrounding said center conductor means, first dielectric means for electrically insulating said center conductor means;

superjacent said first dielectric means, means for distributing electromagnetic radiation with low return loss comprising:

first outer conductor means wrapped around said first dielectric means in a first direction with a first pitch;

plurality of second outer conductor means wrapped around said first dielectric and said first outer conductor means in a second direction with a second pitch wherein the plurality of second outer conductor means are in electrical contact with said first outer conductor means and distributed serially along the length of the first dielectric means.

17. The radiating coaxial cable antenna of claim 16 wherein the first direction is substantially not equal to the second direction.

18. The radiating coaxial cable antenna of claim 16 wherein the first pitch is substantially not equal to the second pitch.

19. The radiating coaxial cable antenna of claim 16 wherein the plurality of second outer conductor means are distributed uniformly along the length of the first dielectric means.

20. A method of constructing a leaky coaxial cable antenna comprising:

extending a center conductor with a length;

disposing a dielectric coaxially along the length of the center conductor;

wrapping a first conductive strip of a first width at a first pitch around the dielectric in a first spiral direction along the length;

wrapping a plurality of second conductive strips of a second width at a second pitch around the dielectric and first conductive strip in a second spiral direction wherein the second conductive strips are in electrical contact with the first conductive strip and distributed serially along the length.

21. The method of claim 20 wherein the second conductive strips are distributed substantially uniformly along the length of the dielectric.

22. The method of claim 21 wherein the first pitch is substantially not equal to the second pitch.

23. The method of claim 22 wherein the first spiral direction is substantially not equal to the second spiral direction.

* * * * *